US008917243B2

(12) United States Patent
Sellers

(10) Patent No.: US 8,917,243 B2
(45) Date of Patent: Dec. 23, 2014

(54) SYSTEM FOR ILLUMINATING A KEYCAP ON A KEYBOARD

(75) Inventor: Charles A. Sellers, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 852 days.

(21) Appl. No.: 11/669,523

(22) Filed: Jan. 31, 2007

(65) Prior Publication Data

US 2008/0179172 A1 Jul. 31, 2008

(51) Int. Cl.
*G09G 5/00* (2006.01)
*H01H 13/83* (2006.01)
*H01H 13/02* (2006.01)

(52) U.S. Cl.
CPC ..... *H01H 13/83* (2013.01); *H01H 13/023* (2013.01); *H01H 2219/018* (2013.01); *H01H 2219/062* (2013.01)
USPC ..... 345/170; 200/314

(58) Field of Classification Search
CPC ..... H01H 13/83; H01H 13/023; H01H 2219/018; H01H 2219/062
USPC ..... 345/168, 170; 341/22; 200/314
See application file for complete search history.

(56) References Cited

U.S. PATENT DOCUMENTS 5,138,119 A * 8/1992 Demeo ..... 200/5 A
5,252,798 A * 10/1993 Kamada ..... 200/314
5,408,060 A * 4/1995 Muurinen ..... 200/314
5,747,756 A 5/1998 Boedecker
5,797,482 A 8/1998 LaPointe et al.
5,899,553 A 5/1999 Howell
6,035,180 A 3/2000 Kubes et al.
6,104,447 A 8/2000 Faris
6,104,604 A 8/2000 Anderson et al.
6,608,271 B2 * 8/2003 Duarte ..... 200/311
6,797,902 B2 9/2004 Farage et al.
6,824,321 B2 11/2004 Ward et al.
7,333,031 B1 * 2/2008 Bantner ..... 341/22
2003/0006128 A1 * 1/2003 Giles et al. ..... 200/314
2007/0268263 A1 * 11/2007 Li et al. ..... 345/170
2008/0117635 A1 * 5/2008 Chen ..... 362/293

* cited by examiner

*Primary Examiner* — Tom Sheng

(74) *Attorney, Agent, or Firm* — Hewlett-Packard Patent Department

(57) ABSTRACT

Systems and methods for illuminating a keycap on a keyboard are described. One system comprises a first light source positioned below the keycap on the keyboard and arranged to illuminate a portion of a bottom of the keycap. The system also comprises a second light source, adjacent the first light source, positioned below the keycap and arranged to illuminate a portion of the bottom of the keycap. One method of illuminating a keycap on a keyboard comprises activating a first light source, wherein the first light source and a second light source are positioned below the keycap on the keyboard, and activating the second light source responsive to the first light source operating outside a predetermined threshold parameter.

9 Claims, 5 Drawing Sheets

SYSTEM FOR ILLUMINATING A KEYCAP ON A KEYBOARD

BACKGROUND

Backlit keyboards comprise a light distribution system for providing illumination to a backside of keys ("keycaps") on the keyboard. The keycaps comprise translucent letters and/or symbols in each keycap enabling illumination provided to the backside of each keycap to pass through the letter and thereby illuminate the letters and/or symbols. In low light/no light conditions, use of a keyboard is difficult.

DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION

Figure 1:
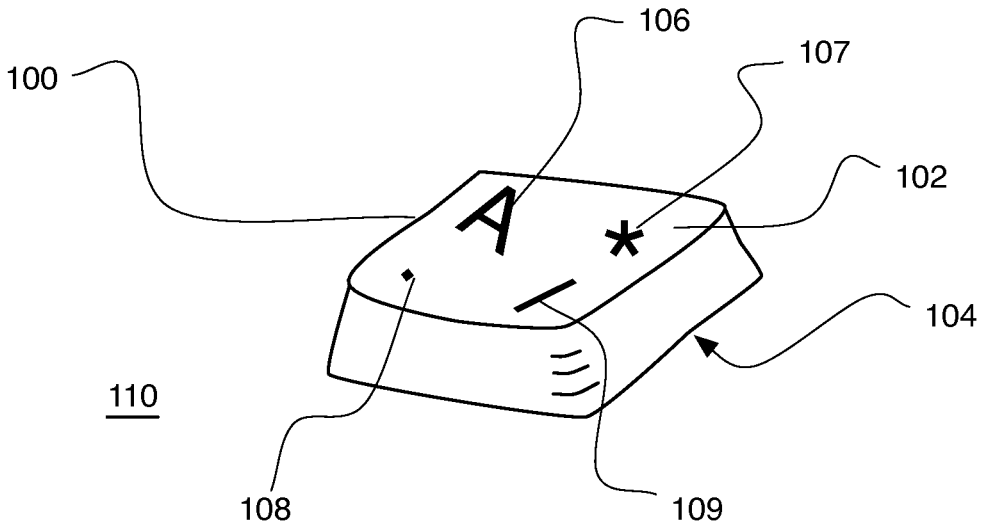
FIG. 1 is a perspective view of a keycap usable in conjunction with an embodiment of the present invention.

FIG. 1 depicts a perspective view of a keycap 100 from a keyboard which is usable in conjunction with an embodiment of the present invention. Keycap 100 comprises a top 102 ("front," "face," "front face," "top face"), a bottom 104 ("back"), and four (4) sides tapering from the bottom to the top. Keycap 100 also comprises letters and symbols, i.e., a letter "A" 106, an asterisk 107, a period 108, and a forward-slash 109, positioned in top 102. The keycap 100 letters and/or symbols are translucent. Keycap 100 is positioned on a keyboard base 110.

In some embodiments, keycap 100 may comprise a lesser or greater number and/or type of letters and/or symbols. In some embodiments, keycap 100 may comprise a different shape, e.g., circular, triangular, polygonal, etc. In some embodiments, keycap 100 may comprise un-tapered sides. In some embodiments, keycap 100 is movably connected with keyboard base 110 to enable movement of the keycap in a horizontal and/or vertical direction with respect to the keyboard base. In some embodiments, keycap 100 letters and/or symbols are transparent.

Figure 2:
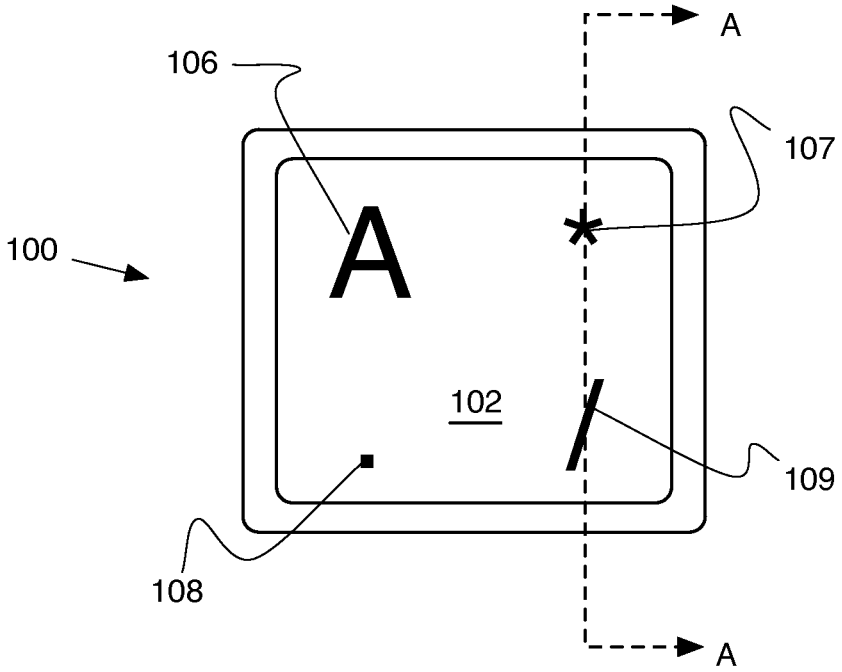
FIG. 2 is a plan view of a keycap.
Figure 3:
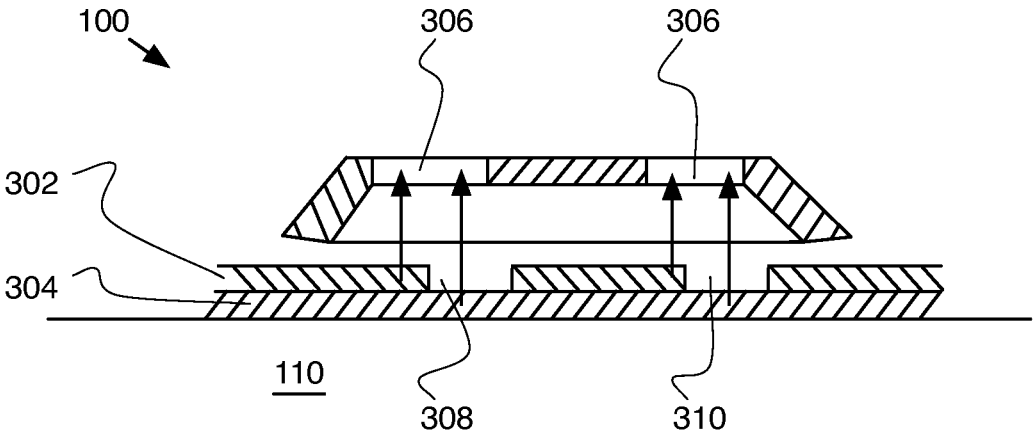
FIG. 3 is a side cross-section view of a keycap on a keyboard in conjunction with an illumination system according to an embodiment.

FIG. 2 depicts a plan view of keycap 100. FIG. 3 depicts a side cross-section view of keycap 100 taken along section A of FIG. 2. Keycap 100 is positioned above an illumination system 300 comprising a pair of illumination-generating layers, i.e., a first light source 302 and a second light source 304. In at least one embodiment, first and second light sources 302, 304 comprise electroluminescent panels. In at least one embodiment, the electroluminescent panels are about 0.3 millimeters (mm) thick enabling two and, in some further embodiments, more than two light sources to be stacked below keycap 100. Keycap 100 further defines a pair of illumination openings 306 each aligned with a corresponding letter and/or symbol in top 102, i.e., asterisk 107 and forward-slash 109. Illumination directed from illumination system 300 toward bottom 104 of keycap 100 passes through illumination openings 306 to illuminate the corresponding letter and/or symbol in top 102 from below.

First light source 302 is positioned above second light source 304 and arranged to illuminate bottom 104 of keycap 100. First light source 302 defines a pair of pass-through regions 308, 310 for enabling illumination from second light source 304 to illuminate bottom 104. In some embodiments, pass-through regions 308, 310 comprise corresponding defined throughholes, i.e., gaps or openings, in first light source 302. In some further embodiments, pass-through regions 308, 310 comprise a transparent or translucent material positioned adjacent or within the defined throughholes in first light source 302. In some embodiments, pass-through regions 308, 310 comprise a substantially equivalent portion of the extent of first light source 302 under keycap 100. In some embodiments, the combined surface area of pass-through regions 308, 310 below keycap 100 is proportional to the surface area of the light emitting portions of first light source 304 below keycap 100.

Second light source 304 is positioned adjacent keyboard base 110 and arranged to illuminate bottom 104 of keycap 100 via pass-through openings 308, 310 of first light source 302.

In some embodiments, first light source 302 and second light source 304 are coupled with keyboard base 110 by a mounting mechanism, e.g., an adhesive, an overlying sheet, a connector applying pressure to retain the light sources 302, 304 in position, a connector passing through light sources 302, 304 to retain the light sources in position.

In some embodiments, first light source 302 and second light source 304 each illuminate at least a portion of bottom 104 of keycap 100. In some embodiments, first light source 302 and second light source 304 each illuminate the entirety of bottom 104 of keycap 100. In some embodiments, first light source 302 and/or second light source 304 may comprise a light emitting diode (LED) panel. In some embodiments, first light source 302 and second light source 304 extend to substantially the length and width of keyboard base 110. In some embodiments, first and second light sources 302, 304 may generate different color (wavelength) light.

Figure 4:
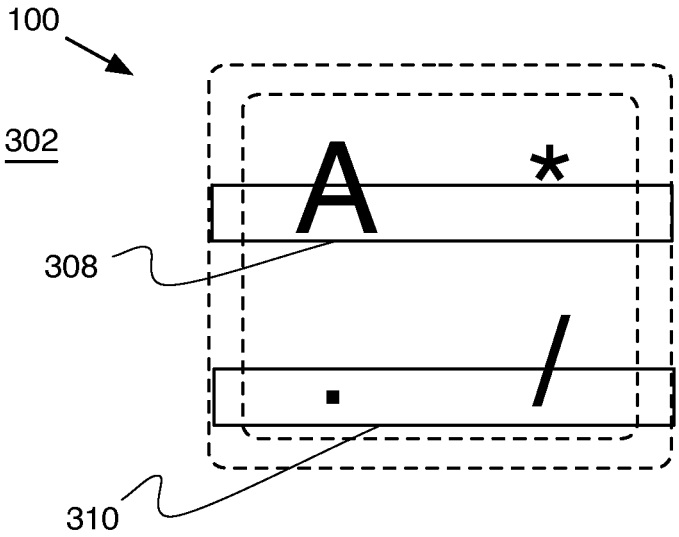
FIG. 4 is a plan view of an illumination system according to the FIG. 3 embodiment.

FIG. 4 depicts a plan view of illumination system 300. For clarity and ease of understanding, keycap 100 is depicted in dashed lines. First light source 302 defines rectangular-shaped pass-through regions 308, 310 below keycap 100. Pass-through regions extend in a parallel manner toward each of a pair of opposing sides of keycap 100. Pass-through regions 308, 310 are similarly-shaped.

In some embodiments, pass-through regions 308, 310 are shaped different from each other and may comprise non-rectangular shapes, e.g., circular, elliptical, triangular, polygonal, etc. In some embodiments, there may be more than two pass-through regions below keycap 100. In some embodiments, pass-through regions 308, 310 may extend beyond the sides of keycap 100.

In some embodiments, there may be more than two light sources stacked on top of each other above keyboard base 110. In the particular embodiment of multiple stacked light sources, the upper-most light sources, i.e., light sources positioned to have another light source between the light source and keyboard base 110, each define one or more aligned, pass-through regions similar to regions 308, 310. In some embodiments, the aligned, pass-through regions are nested to allow illumination to transmit to illuminate the bottom of keycap 100 from the lowest level light source.

Figure 5:
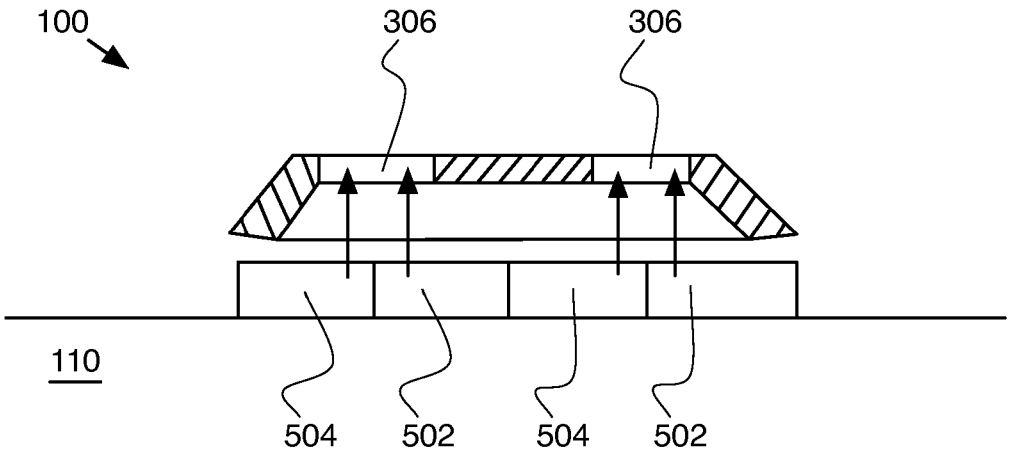
FIG. 5 is a side cross-section view of a keycap on a keyboard in conjunction with an illumination system according to another embodiment.

FIG. 5 depicts a plan view of an illumination system 500 comprising a pair of illumination-generating layers, a first light source 502 and a second light source 504, similar to first and second light sources 302, 304. Keycap 100 comprises illumination openings 306 aligned with a corresponding letter and/or symbol in top 102. Illumination directed from illumination system 500 toward bottom 104 of keycap 100 passes through illumination openings 306 to illuminate the corresponding letter and/or symbol in top 102 from below.

First light source 502 is positioned aside second light source 504 in an interlineated manner and adjacent keyboard base 110. First light source 502 is arranged to illuminate bottom 104 of keycap 100. Second light source 504 is positioned aside first light source 502 and adjacent keyboard base 110. In some embodiments, first light source 502 comprises a substantially equivalent portion of the extent of second light source 504 under keycap 100. In some embodiments, the surface area of first light source 502 is proportional to the surface area of second light source 504 below keycap 100.

In some embodiments, first light source 502 and second light source 504 each illuminate at least a portion of bottom 104 of keycap 100. In some embodiments, first light source 502 and/or second light source 504 may comprise an electroluminescent panel and a light emitting diode (LED) panel. In some embodiments, first and second light sources 502, 504 may generate different color (wavelength) light. In some embodiments, there may be more than two light sources interlineated below keycap 100.

Figure 6:
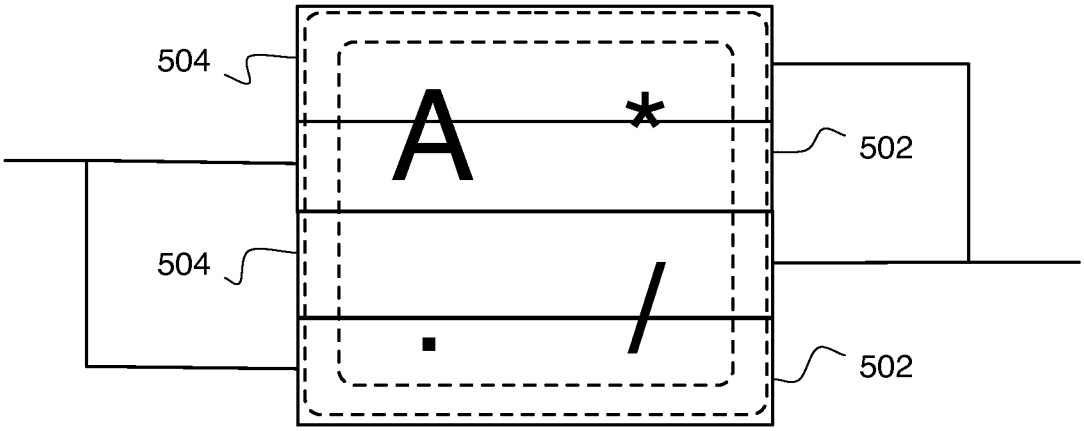
FIG. 6 is a plan view of an illumination system according to the FIG. 5 embodiment.

FIG. 6 depicts a plan view of illumination system 500. For clarity and ease of understanding, keycap 100 is depicted in dashed lines. First light source 502 comprises a pair of electrically-coupled, rectangular-shaped panels. Second light source 504 comprises another pair of electrically-coupled, rectangular-shaped panels. First light source 502 panels are interlineated with second light source 504 panels.

In some embodiments, first light source 502 panels and second light source 504 panels are shaped different from each other and may comprise different shapes, e.g., circular, elliptical, triangular, polygonal, etc. In some embodiments, there may be more than two panels per light source 502, 504 below keycap 100. In some embodiments, first and second light source 502, 504 may extend beyond the sides of keycap 100.

Figure 7:
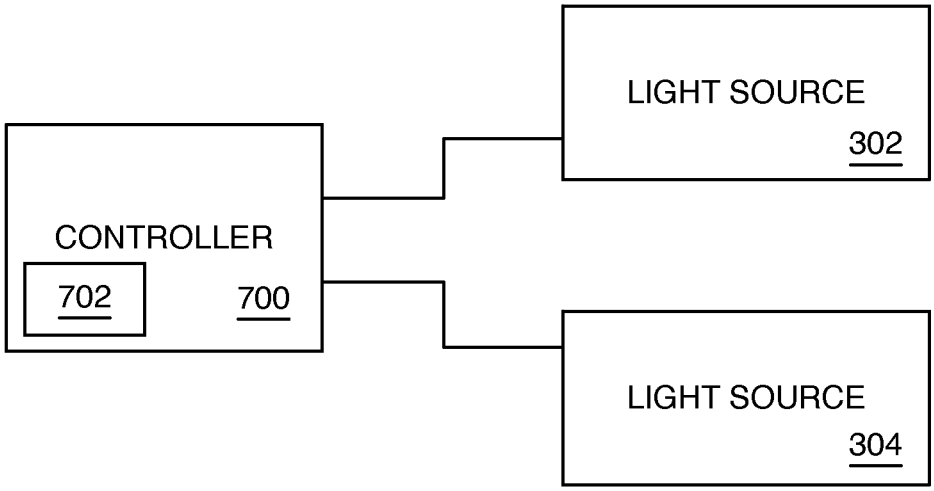
FIG. 7 is a high-level functional block diagram of an illumination system in conjunction with a controller according to an embodiment.

FIG. 7 depicts a high-level functional block diagram of illumination system 300 in conjunction with a controller 700. In some embodiments, illumination system 500 may be used in place of, or in conjunction with, illumination system 300. Controller 700 is communicatively coupled with illumination system 300 to control operation of first light source 302 and second light source 304. In some embodiments, controller 700 is a hardware and/or software control system, e.g., a controller, application-specific integrated circuit, processor, etc.

In operation, controller 700 generates and transmits an activate signal to first light source 302 causing the light source to activate, i.e., generate illumination to illuminate keycap 100 letters and/or symbols. Controller 700 does not transmit an activate signal to second light source 304 and the light source does not generate illumination. In some embodiments, controller 700 generates and transmits a deactivate signal to second light source 304 in order to prevent the light source from generating illumination.

Controller 700 monitors, via the coupling between the controller and the first light source, a parameter of the first light source related to the operation of the first light source during the period in which the light source is generating illumination. In some embodiments, the monitored parameter may comprise an operating time, illumination brightness, current draw, resistance value, or other light source-related operating parameter.

Controller 700 comprises a predetermined threshold parameter 702, e.g., a value representing an operating time, illumination brightness, current draw, resistance value, or other light source-related operating value. In some embodiments, predetermined threshold parameter 702 may be stored in a memory.

Responsive to controller 700 determining that the monitored first light source 302 operating parameter is outside predetermined threshold parameter 702, e.g., the operating time of the light source exceeds a maximum operating lifetime for the light source, the monitored brightness or the light source falls below a minimum brightness for the light source, the current draw of the light source exceeds the maximum current draw specified for the light source, etc., the controller generates and transmits a deactivate signal to first light source 302 causing the first light source to deactivate ("turn off"). Controller 106 also generates and transmits an activate signal to second light source 304 causing the second light source to activate, i.e., generate illumination to illuminate keycap 100 letters and/or symbols. In this manner, the lifetime of the illumination for the keycap may be extended beyond the lifetime of a single light source.

Figure 8:
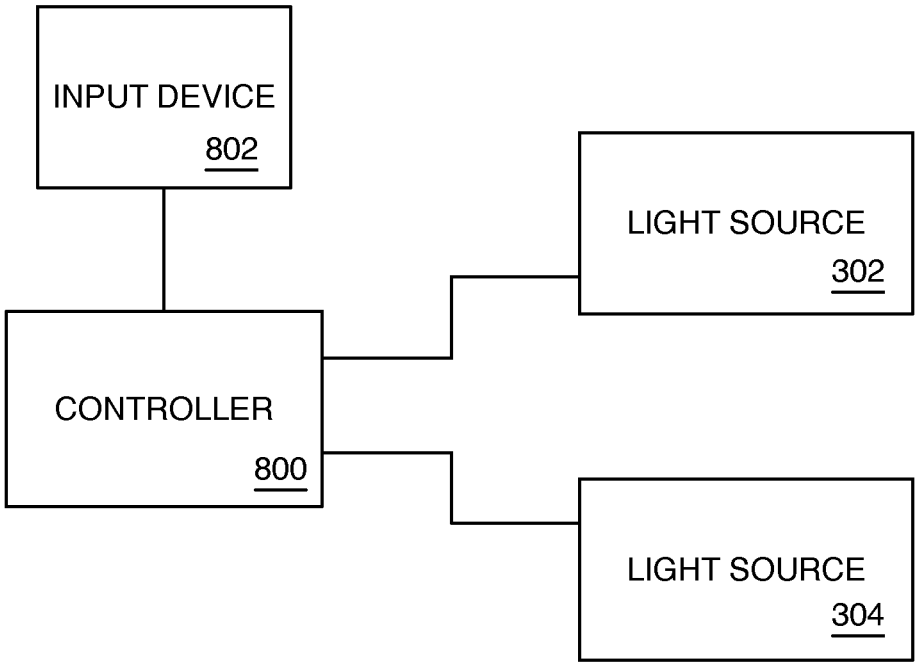
FIG. 8 is a high-level functional block diagram of an illumination system in conjunction with a controller and an input device according to another embodiment.

FIG. 8 depicts a high-level functional block diagram of illumination system 500 in conjunction with a controller 800 similar to controller 700 (FIG. 7) and an input device 802 communicatively coupled with the controller. In some embodiments, illumination system 500 may be used in place of, or in conjunction with, illumination system 300. Controller 800 is communicatively coupled with illumination system 300 to control operation of first light source 302 and second light source 304. In some embodiments, controller 800 is a hardware and/or software control system, e.g., a controller, application-specific integrated circuit, processor, etc.

In some embodiments, input device 802 comprises a hardware and/or software switch activatable by a user. In some embodiments, a user may manipulate input device 802 directly, e.g., in the form of a switch, to generate a signal to cause controller 800 to cause first light source 302 to deactivate and to cause second light source 304 to activate. In some embodiments, input device 802 comprises a software control manipulable by a user operating a computer or processor-based device to which the keyboard comprising keycap 100 and illumination system 300 is attached. Manipulation of the software control by the user causes the generation and transmission of a signal to controller 800 to cause the controller to control first light source 302 and/or second light source 304.

In operation, controller 800 generates and transmits an activate signal to first light source 302 causing the light source to activate, i.e., generate illumination to illuminate keycap 100 letters and/or symbols. Controller 800 does not transmit an activate signal to second light source 304 and the light source does not generate illumination. In some embodiments, controller 800 generates and transmits a deactivate signal to second light source 304 in order to prevent the light source from generating illumination.

Responsive to receipt of a signal from input device 802, controller generates and transmits a deactivate signal to first light source 302 causing the first light source to deactivate ("turn off"). Controller 106 also generates and transmits an activate signal to second light source 304 causing the second light source to activate, i.e., generate illumination to illuminate keycap 100 letters and/or symbols. According to the present embodiment, control of illumination system 300 is exercised under control of a user via input device 802.

In at least one further embodiment, controller 800 may be configured to be both responsive to input device 802 and operate according to predetermined threshold parameter 702 (FIG. 7).

Figure 9:
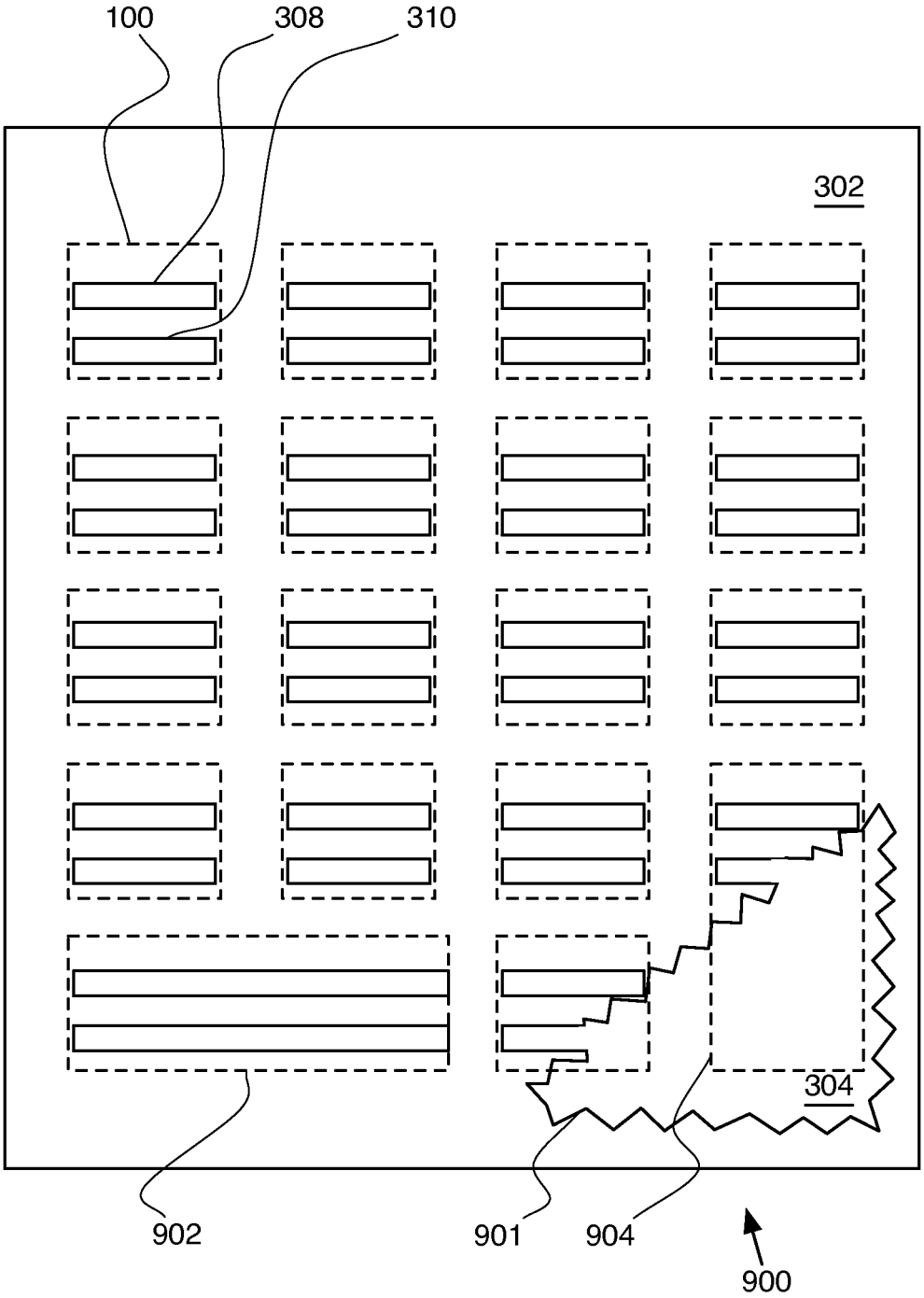
FIG. 9 is a schematic diagram of a keypad usable in conjunction with an illumination system according to an embodiment.

FIG. 9 depicts a schematic diagram of a keypad 900 in conjunction with illumination system 300 comprising first light source 302 overlying second light source 304. A lower right, corner portion of first light source 302 has been removed for clarity as indicated by cutaway region 901.

Keypad 900 comprises a grid-like arrangement of a plurality of keycaps 100 (depicted in dashed lines for clarity). Keypad 900 further comprises an extended width keycap 902, e.g., a larger zero ("0") key, and an extended height keycap 904, e.g. an enter key.

For simplicity and ease of understanding, one of the plurality of keycaps 100 is described, however, the description applies equally to the remaining keycaps 100 and extended keycaps 902, 904. First light source 302 comprises a plurality of pairs of pass-through regions 308, 310 arranged below a corresponding one of the plurality of keycaps 100, 902, 904. The plural pairs of pass-through regions 308, 310 enable the transmission of illumination from second light source 304 through first light source 302 to bottom 104 of keycaps 100 to illuminate the letters and/or symbols 106-109.

Keycap 904 comprises a second pair of pass-through regions 308, 310 based on the extended height of the keycap. Keycap 902 comprises extended width pass-through regions 308, 310 in comparison to the pass-through regions of keycaps 100 based on the extended width of the keycap. In some embodiments, pass-through regions 308, 310 may comprise a width and/or length smaller than the keycap as long as the letter and/or symbol receives sufficient illumination to be illuminated.

In some embodiments, a single pass-through region 308 may be used to enable transmission of illumination from second light source 302 through first light source 304 to bottom of keycaps 100. In some embodiments, first light source 302 and/or second light source 304 may comprise smaller individual light source panels arranged below keycaps 100.

What is claimed is:

1. A system for illuminating a plurality of keycaps on a keyboard, comprising:

a first light source positioned below the plurality of keycaps on the keyboard and arranged to illuminate a first portion of a bottom of each of the plurality of keycaps;

a second light source, adjacent the first light source, positioned below the plurality of keycaps and arranged to illuminate a second portion of the bottom of each of the plurality of keycaps; and a light source controller coupled to the first light source and the second light source, wherein the light source controller is arranged to activate one of the first light source and the second light source based on a determination of operation outside a predetermined threshold parameter by one of the first light source and the second light source.

2. The system as claimed in claim 1, wherein the predetermined threshold parameter comprises at least one of operating time, illumination brightness, current draw, and resistance value.

3. The system as claimed in claim 1, wherein the light source controller is arranged to communicate with an input device external to the keyboard.

4. The system as claimed in claim 3, wherein the input device comprises a switch.

5. The system as claimed in claim 1, further comprising:

an input device coupled to the light source controller.

6. A method of illuminating a keycap on a keyboard, comprising:

activating a first light source, wherein the first light source and a second light source are positioned below the keycap on the keyboard; and activating the second light source responsive to the first light source operating outside a predetermined threshold parameter.

7. The method as claimed in claim 6, further comprising:

deactivating the first light source responsive to the first light source operating outside the predetermined threshold parameter.

8. The method as claimed in claim 6, further comprising activating the second light source in response to the first light source operating outside at least one predetermined threshold parameter selected from the group of an operating time, an illumination brightness, a current draw, and a resistance value.

9. The method as claimed in claim 6, further comprising monitoring the first light source operation.

* * * * *